US005986413A

United States Patent [19]

Zijlman

[11] Patent Number: 5,986,413

[45] Date of Patent: Nov. 16, 1999

[54] RELIABLE IGNITION CIRCUIT FOR A HIGH PRESSURE DISCHARGE LAMP

[75] Inventor: Theo G. Zijlman, Eindhoven, Netherlands

[73] Assignee: U.S. Philips Corporation, New York, N.Y.

[21] Appl. No.: 09/088,718

[22] Filed: Jun. 1, 1998

[30] Foreign Application Priority Data

Jul. 4, 1997 [EP] European Pat. Off. ..... 97202077

[51] Int. Cl.[6] ..... H05B 41/00

[52] U.S. Cl. ..... 315/291; 315/291; 315/DIG. 5; 315/289; 315/307

[58] Field of Search ..... 315/DIG. 5, 289, 315/291, 283, 307, 308

[56] References Cited

U.S. PATENT DOCUMENTS 3,996,495 12/1976 Herman ..... 315/244
4,523,795 6/1985 Johnson et al. ..... 315/97
5,233,273 8/1993 Waki et al. ..... 315/224

FOREIGN PATENT DOCUMENTS

WO9528068 10/1995 WIPO ..... H05B 41/04

*Primary Examiner*—Hoanganh Le
*Assistant Examiner*—Tuyet Vo
*Attorney, Agent, or Firm*—Bernard Franzblau

[57] ABSTRACT

A circuit arrangement suitable for igniting a high-pressure discharge lamp and provided with input terminals for connection to a voltage source. A pulse generating circuit includes a switch, a primary winding of a pulse transformer, and a non-linear capacitor which shunts the switch and the primary winding. An electrical connection is provided between a secondary winding of the pulse transformer and lamp connection terminals. The non-linear characteristic of the capacitor results in a more reproducible amplitude of the generated ignition voltage pulse.

10 Claims, 3 Drawing Sheets

RELIABLE IGNITION CIRCUIT FOR A HIGH PRESSURE DISCHARGE LAMP

BACKGROUND OF THE INVENTION

This invention relates to a circuit arrangement suitable for igniting a high-pressure discharge lamp and provided with input terminals for connection to a voltage source;

a pulse generating circuit provided with a switch, a primary winding of a pulse transformer, and capacitive means, which capacitive means shunt the switch and the primary winding; and an electrical connection between a secondary winding of the pulse transformer and lamp connection terminals.

A circuit arrangement of the kind mentioned in the opening paragraph is known from WO-A-95/28068. The known circuit arrangement is suitable for igniting a high-pressure discharge lamp which has a very high ignition voltage. Ignition pulses of a sufficient width and with an amplitude of up to 25 kV can be realized by means of the known circuit arrangement. It is required for an optimum operation of the known circuit arrangement, however, that two resonant circuits should be mutually attuned. The pulse generating circuit acts as the first resonant circuit. The second resonant circuit is the circuit formed by the secondary winding of the pulse transformer and the lamp connected to the lamp connection terminals. It is indeed possible to form high ignition voltage pulses in this manner, but it is a disadvantage that a slight mutual detuning of the resonant circuits already strongly reduces the maximum level of the generated voltage pulse. A further disadvantage is that the phase angle between the voltages generated in each resonant circuit will not necessarily be an integer number of times 180°, also in the case of an optimum mutual attuning. This again leads to a limitation in the level of the voltage pulse which can be generated.

Although it is also possible to ignite the lamp some time after it has extinguished, but has not yet cooled down, by means of the known circuit arrangement, a reliable instantaneous hot re-ignition is found to be substantially not possible.

It is an object of the invention to provide a circuit arrangement of the kind mentioned in the opening paragraph in which the above disadvantages are counteracted to a considerable extent.

SUMMARY OF THE INVENTION

According to the invention, this object is achieved in a circuit arrangement of the kind mentioned in the opening paragraph in that the capacitive means have a non-linear characteristic. The invention offers the advantage that the level of the generated ignition voltage pulse is largely determined by the second resonant circuit. Owing to the non-linearity of the capacitive means, the resonance frequency of the first resonant circuit formed by the pulse generating circuit will decrease with a decreasing voltage across the capacitive means. This has the result that the voltage across the primary winding of the pulse transformer falls with a correspondingly decreasing frequency after the switch has become conductive. An advantageous further result of this is that a generated pulse having a fixed pulse amplitude will have a greater pulse width, and accordingly a higher energy content, in the case of the invention. This is favorable for reliable ignition of a connected lamp, and in particular for the reliable, substantially instantaneous hot re-ignition thereof. In the circuit arrangement according to the invention, preferably, the switch has a breakdown voltage, and the capacitive means having the non-linear characteristic have a capacitance value at said breakdown voltage which is at most 50% of the capacitance value at 0 V. The circuit arrangement is particularly suitable for igniting a high-pressure discharge lamp which forms part of a lighting system which must provide light substantially instantaneously after switching-on, as is the case with PTV and in headlamp systems for motor vehicles. The use of capacitive means having a non-linear characteristic in general has the further advantage that an initially smaller capacitance can suffice as compared with the known circuit arrangement. This is usually accompanied by correspondingly smaller dimensions of the capacitive means, which has the advantage that a miniaturization of the circuit arrangement is possible as compared with the known circuit arrangement, while the pulse width and pulse height are retained. If the capacitive means having the non-linear characteristic are not connected electrically in parallel to the switch, as in the invention, but in series therewith, this will lead to an increase in the resonance frequency of the first resonant circuit when the switch becomes conductive. A result of this is that the amplitude of the generated voltage pulse is at least equally strongly influenced by the resonance frequency of the first resonant circuit as in the prior art circuit arrangement.

Preferably, a tuning self-inductance is connected in series with the switch and with the primary winding in a circuit arrangement according to the invention. A very effective attuning between height and width of the pulse to be generated by the circuit arrangement can be achieved in a simple manner through the choice of the value of the tuning self-inductance. Although such a tuning can be theoretically realized by means of a suitable choice of the winding ratio between the primary and the secondary winding of the pulse transformer, an actual realization of this often gives rise to practical problems. The tuning self-inductance can be realized in a very advantageous manner in the form of a planar conductor of a printed circuit, which is highly favorable for an even further miniaturization.

BRIEF DESCRIPTION OF THE DRAWINGS

The above and further aspects of the circuit arrangement according to the invention will be explained in more detail with reference to a drawing of an embodiment.

In the drawing.

DESCRIPTION OF THE PREFERRED EMBODIMENTS

Figure 1:
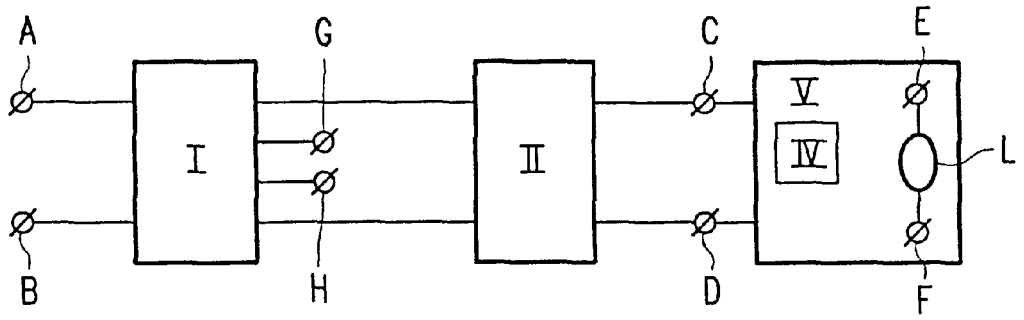
FIG. 1 is a diagram of a circuit for igniting and operating a lamp, provided with a circuit arrangement according to the invention.

FIG. 1 diagrammatically shows a headlamp system for a motor vehicle, where A and B are connection terminals for connecting a supply source, for example, a car battery. I denotes a switch mode power supply by means of which a commutator circuit II is supplied. The commutator circuit acts as a commutating supply source delivering a square-wave supply voltage. The commutator circuit II is connected via input terminals C and D to a lamp circuit V, which comprises a pulse generating circuit IV and lamp connection terminals E and F between which a lamp L is connected. The switch mode power supply I has connection points G and H for supplying the pulse generating circuit IV. The lamp circuit V is shown in FIG. 2 as forming part of the circuit of FIG. 1.

Figure 2:
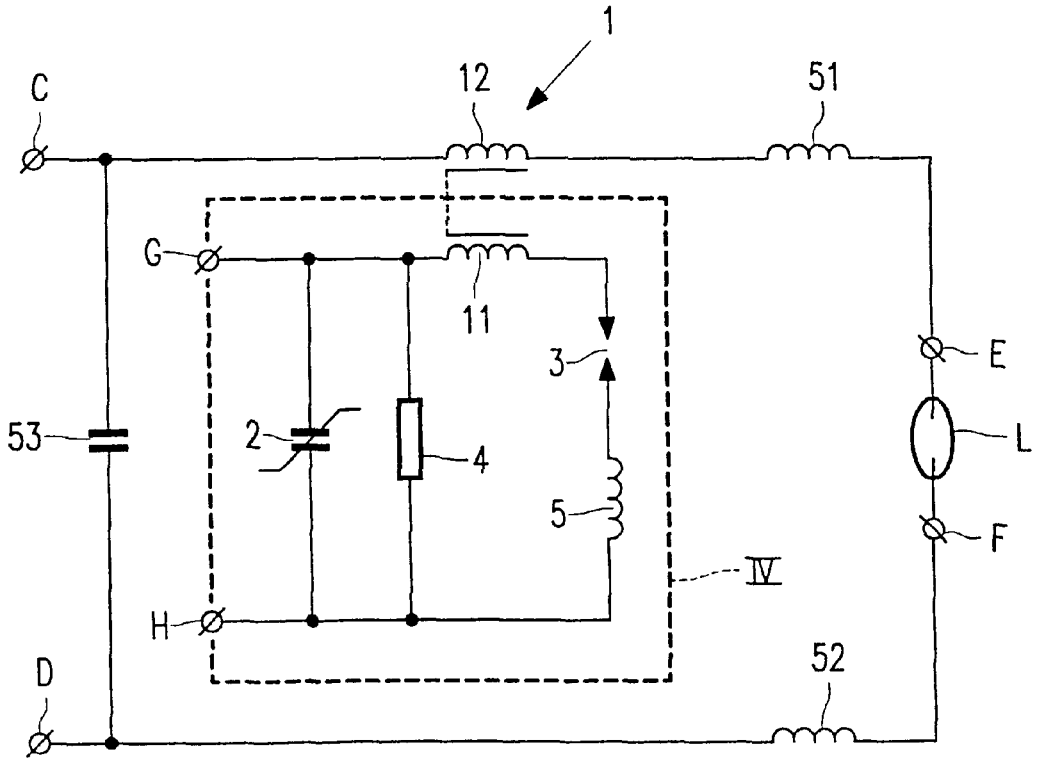
FIG. 2 is a diagram of the circuit arrangement of FIG. 1.

In FIG. 2, the input terminal C is connected to a pulse transformer 1. A secondary winding 12 of transformer 1 is directly connected at one side to input terminal C. At the other side, the secondary winding 12 is connected to lamp connection terminal E via a self-inductance 51, thus forming an electrical connection between the secondary winding of the pulse transformer and the lamp connection terminals. Input terminal D is connected to a lamp connection terminal F via a self-inductance 52. The input terminals C and D are also interconnected by means of a capacitor 53. A primary winding 11, forming part of the pulse generating circuit IV, of the pulse transformer 1 is connected in series with a voltage-dependent breakdown element 3 between connection terminals G and H. A parallel circuit of a capacitor 2 and a resistor 4 shunts the series circuit of primary winding 11 and breakdown element 3. Capacitor 2 has a non-linear characteristic, thus forming the capacitive means having a non-linear characteristic. A tuning self-inductance 5 is also included in series with the breakdown element, whereby the width of the pulse to be generated is defined. In the embodiment described, the pulse generating circuit IV together with the secondary winding 12 and the self-inductances 51 and 52 constitute the circuit arrangement according to the invention.

In a practical realization of the headlamp system for a motor vehicle in accordance with the embodiment described, the circuit arrangement is suitable for igniting and operating a high-pressure discharge lamp, both of the DS2 and of the D2R type, both made by Philips, with a power rating of 35 W and a nominal lamp voltage of 85 V. The lamp has a hot re-ignition voltage of at most 23 kV. The lamp has a lamp cap which is capable of withstanding a voltage of at most 34 kV. The circuit arrangement is designed for a nominal ignition voltage pulse of 27 kV. The switch mode power supply I is of the flyback type and forms an open voltage at connection terminals G and H of 800 V DC from a car battery voltage of 12 V. The capacitor 2 having the non-linear characteristic is a ceramic capacitor, type X7R, make AVX, which has a capacitance value of 144 nF at 0 V and 47% of the 0 V-value at 800 V, i.e. 68 nF. The capacitor is shunted by a resistor 4 of 1.5 MΩ, which serves to allow the residual charge of the capacitor 2 to flow away. The breakdown element 3 is a spark gap, make Siemens, with a breakdown voltage of 800 V. The pulse transformer 1 is constructed from a ferrite core with a primary winding of three turns having a self-inductance value of 320 nH, and a secondary winding of 120 turns having a self-inductance value of 550 $\mu$H. A magnetic coupling with a coupling factor k of 0.85 obtains between the primary and the secondary windings. The tuning self-inductance 5 is 108 nH. Capacitor 53 of 1.5 nF forms a protection for the commutator switches against the voltage pulses generated in the circuit arrangement. The self-inductances 51 and 52 have a value of 22 $\mu$H.

Figure 3:
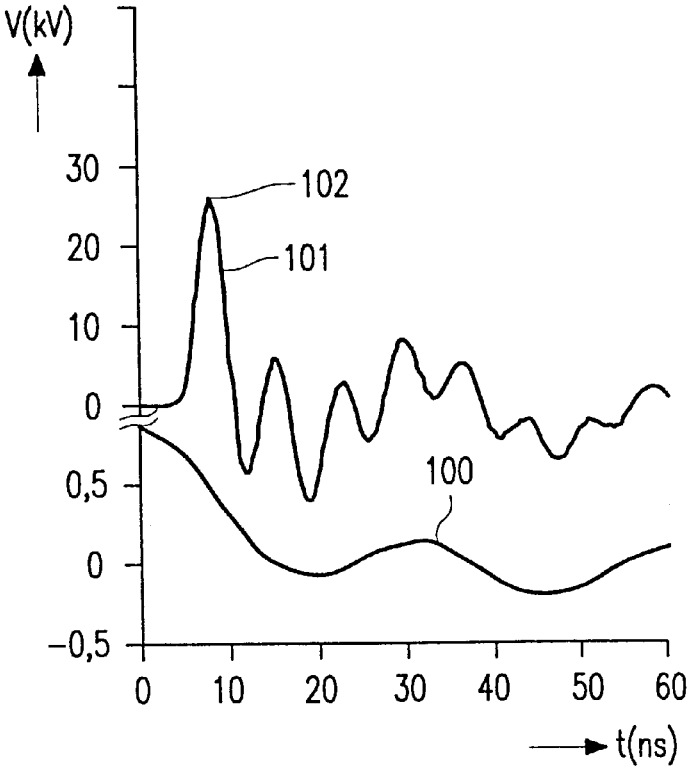
FIG. 3 is a graph showing a voltage gradient in the circuit arrangement of FIG. 2.

A graph of the voltage gradient as a function of time of the practical realization of the circuit arrangement is shown in FIG. 3, the time in ns being plotted on the horizontal axis and the voltage in kV on the vertical axis. Curve 100 in the graph shows the voltage across the primary winding as a function of time. Curve 101 shows the voltage across the secondary winding in a similar manner. It is required for a reliable ignition of the lamp that the first voltage pulse across the secondary winding should have the required high value as well as a sufficient energy content. The first pulse in the graph, referenced 102, has a value of 25 kV. The width of the pulse serves as a measure for the energy content. This is preferably expressed as the rise time of the voltage pulse between 10% and 90% of the pulse amplitude. This value is 100 ns in pulse 102. It is apparent from the gradient of curve 100 that the voltage across the primary winding drops from 800 V to 540 V during the time in which the first pulse 102 reaches its maximum value. The connected lamp is found to re-ignite substantially instantaneously after extinction in the hot state by means of the pulse thus formed.

Figure 4:
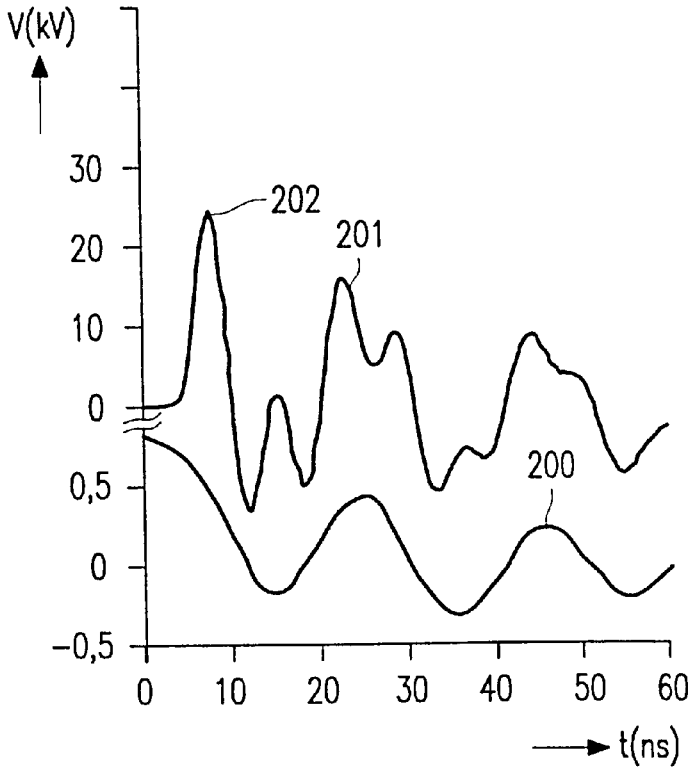
FIG. 4 is a graph comparable to that of FIG. 3 and relating to a prior art circuit arrangement.

For comparison, FIG. 4 shows a graph of the voltage gradient in a prior art circuit arrangement, which differs from the circuit arrangement according to the invention only in that the capacitive means have a fixed capacitance value of 68 nF. It can be seen from the graph that the first voltage pulse 202 of the voltage across the secondary winding, curve 201, has a maximum level of 23 kV for the same rise time of 100 ns. The voltage across the primary winding is found to fall during this time from 800 V down to 460 V, as is apparent from curve 200. No reliable instantaneous hot re-ignition of the lamp takes place with this generated pulse. Research has shown that a rise time of 105 ns is necessary in order to achieve a comparable reliable, substantially instantaneous re-ignition at a pulse amplitude of 23 kV. To realize a pulse amplitude of 25 kV in this circuit arrangement, while retaining the rise time of 100 ns, it was found that the capacitive means have to have a value of at least 120 nF.

Figure 5:
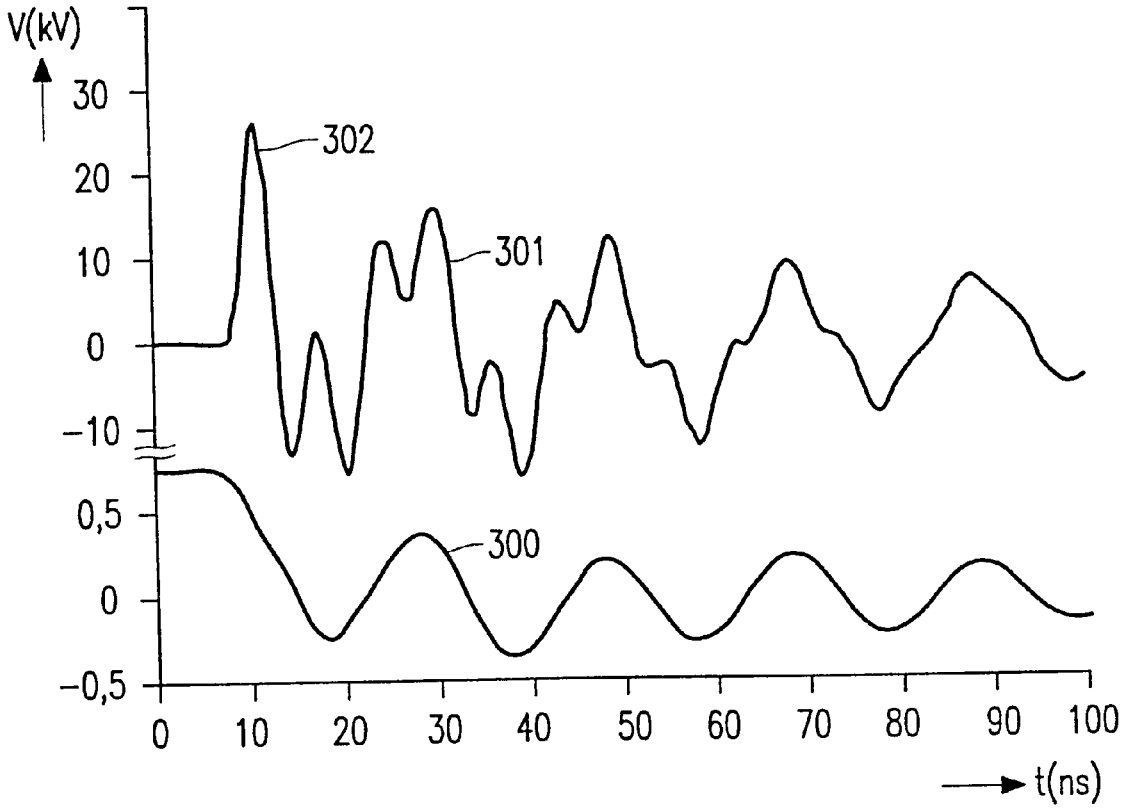
FIG. 5 is a graph comparable to that of FIG. 4 and relating to a further prior art circuit arrangement.

A graph in FIG. 5 comparable to that of FIG. 4 relates to a further circuit arrangement according to the prior art, where the tuning self-inductance in the circuit arrangement has a value of 0 nH, and the capacitive means have a fixed value of 68 nF. It is apparent from the graph that the voltage across the secondary winding, curve 301, has a first voltage pulse 302 of 26 kV. This is accompanied by a rise time of no more than 86 ns. The voltage across the primary winding, curve 300, drops from 800 V to 450 V during this time. Although the pulse amplitude of the first voltage pulse corresponds to that of FIG. 3, the rise time is considerably shorter, which results in a substantially smaller energy content of the generated pulse. Indeed, a reliable, substantially instantaneous hot re-ignition is found not to take place then. It is necessary to give the capacitive means a value of at least 136 nF if a substantially instantaneous hot re-ignition is to be made possible with this known circuit arrangement.

It is clear from the above that a pulse having a greater width can be realized by means of a non-linear capacitor, given a certain pulse amplitude. This strongly promotes a quick re-ignition of the lamp and also has the advantage that the capacitor can have comparatively small dimensions, which opens up further perspectives for miniaturization of the circuit arrangement.

I claim:

1. A circuit arrangement for igniting a high-pressure discharge lamp comprising:

input terminals for connection to a voltage source;

a pulse generating circuit coupled to said input terminals and provided with a switch, a primary winding of a pulse transformer, and capacitive means which shunt the switch and the primary winding; and an electrical connection between a secondary winding of the pulse transformer and lamp connection terminals, characterized in that the capacitive means have a non-linear characteristic.

2. A circuit arrangement as claimed in claim 1, wherein the switch has a breakdown voltage, and the capacitive means having the non-linear characteristic have a capacitance value at said breakdown voltage which is at most 50% of the capacitance value at 0 V.

3. A circuit arrangement as claimed in claim 2 further comprising a tuning inductance connected in series circuit with the switch and the pulse transformer primary winding.

4. A circuit arrangement as claimed in claim 3 wherein the capacitive means is connected in shunt with a series circuit comprising the switch, the pulse transformer primary winding and the tuning inductance.

5. A circuit arrangement as claimed in claim 1, further comprising a tuning self-inductance connected in series with the switch and with the primary winding.

6. A circuit arrangement as claimed in claim 5, wherein the tuning self-inductance is constructed as a planar conductor of a printed circuit.

7. A circuit arrangement as claimed in claim 5 wherein the capacitive means is connected in shunt with a series circuit comprising the switch, the pulse transformer primary winding and the tuning self-inductance.

8. A circuit arrangement as claimed in claim 1 wherein the switch and pulse transformer primary winding are connected in a first series circuit to said input terminals, and said electrical connection connects the pulse transformer secondary winding and the lamp connection terminals in a second series circuit to further terminals of the voltage source.

9. A circuit arrangement as claimed in claim 1 wherein the switch, the pulse transformer primary winding and the capacitive means form a first resonant circuit whose resonant frequency varies with the-capacitance of the capacitive means, and the pulse transformer secondary winding and a high-power discharge lamp when connected to said lamp connection terminals form a second resonant circuit having a resonant frequency whereby the amplitude of an ignition voltage pulse generated by the pulse generating circuit is largely determined by the second resonant circuit.

10. A circuit arrangement as claimed in claim 1 wherein said voltage source comprises a battery of a motor vehicle, and further comprising a switched mode power supply coupled between terminals of the battery and said input terminals.

* * * * *